US009282420B2

(12) United States Patent
Leitch

(10) Patent No.: US 9,282,420 B2
(45) Date of Patent: Mar. 8, 2016

(54) METHOD AND SYSTEM FOR MULTI-CHANNEL MIXING FOR TRANSMISSION OF AUDIO OVER A NETWORK

(71) Applicant: Calgary Scientific Inc., Calgary (CA)

(72) Inventor: Sam Anthony Leitch, Calgary (CA)

(73) Assignee: Calgary Scientific Inc. (CA)

( * ) Notice: Subject to any disclaimer, the term of this patent is extended or adjusted under 35 U.S.C. 154(b) by 303 days.

(21) Appl. No.: 13/925,245

(22) Filed: Jun. 24, 2013

(65) Prior Publication Data

US 2013/0343548 A1 Dec. 26, 2013

Related U.S. Application Data

(60) Provisional application No. 61/663,722, filed on Jun. 25, 2012.

(51) Int. Cl.
*H04S 7/00* (2006.01)
*H04R 27/00* (2006.01)

(52) U.S. Cl.
CPC *H04S 7/00* (2013.01); *H04R 27/00* (2013.01); *H04R 2227/003* (2013.01); *H04R 2420/07* (2013.01)

(58) Field of Classification Search
CPC ..... H04H 60/04
USPC ..... 381/56, 119, 77, 80; 700/94
See application file for complete search history.

(56) References Cited

U.S. PATENT DOCUMENTS

| | | | | |
|---|---|---|---|---|
| 8,020,102 | B2 * | 9/2011 | Sokol et al. | 715/727 |
| 8,694,137 | B2 * | 4/2014 | Winterstein et al. | 700/94 |
| 2007/0223675 | A1 | 9/2007 | Surin et al. | |
| 2007/0253557 | A1 * | 11/2007 | Song | H04H 60/04 381/56 |
| 2007/0274540 | A1 * | 11/2007 | Hagen | H04M 3/569 381/119 |
| 2008/0212785 | A1 * | 9/2008 | Ullmann | 381/2 |
| 2012/0170760 | A1 * | 7/2012 | Virolainen | G10L 19/008 381/56 |
| 2014/0369528 | A1 * | 12/2014 | Ellner | H04N 21/2368 381/119 |

* cited by examiner

*Primary Examiner* — Disler Paul
(74) *Attorney, Agent, or Firm* — Meunier Carlin & Curfman LLC

(57) ABSTRACT

A method and system for providing remote access to multi-channel audio by periodically polling channels of audio produced by, e.g., an application program by calling an Application Programming Interface (API). A method performs the polling to retrieve audio data from multiple channels and to mix the multiple channels into a mixed multichannel audio that is communicated to a remote computing device. The method transmits a sample minimum duration of audio data retrieved from all channels during at polling interval to provide low latency transmission of audio to remotely connected computing devices.

20 Claims, 9 Drawing Sheets

800

METHOD AND SYSTEM FOR MULTI-CHANNEL MIXING FOR TRANSMISSION OF AUDIO OVER A NETWORK

CROSS-REFERENCE TO RELATED APPLICATION

The present application claims priority to U.S. Provisional Patent Application No. 61/663,722, filed Jun. 25, 2012, entitled "Method and System for Multi-Channel Mixing for Transmission of Audio over a Network," the disclosure of which is incorporated herein by reference in its entirety.

BACKGROUND OF THE DISCLOSURE

Ubiquitous remote access to services, application programs and data has become commonplace as a result of the growth and availability of broadband and wireless network access. However, there exist application programs that were not designed for remote network access over, e.g., the Internet. These application programs range from older, mainframe applications that have been traditionally accessed by terminals to single user applications designed to be executed on a local computing device. Further, such applications were not designed to be executed on the variety of computing devices that exist today. For example, many applications are developed to be executed on a specific computing architecture, making it impossible for them to be used by smart phones, tablet devices, etc.

In addition, there has been a push toward a cloud computing model, i.e., providing applications and data as "services" over a network. Cloud computing has several benefits in that services may be provided quickly and easily, as computing resources can be dedicated and removed based on needs. In the cloud computing model, end-users access "cloud-based" applications through, e.g., a web browser or other lightweight desktop or mobile app, where the applications may be any type of application and/or data executed and/or are stored on a remote server. The goal of cloud computing is provide end-users an experience as if the applications and data were installed and accessed locally on an end-user computing device.

However, while there are many benefits to providing remote access to applications, there exist features of applications, such as multi-channel audio, which cannot be remotely provided to end-users in certain remote access environments.

SUMMARY OF THE DISCLOSURE

A method and system for providing remote access to multichannel audio by periodically polling channels of audio produced by, e.g., an application program by calling an Application Programming Interface (API). A method performs the polling to retrieve audio data from multiple channels and to mix the multiple channels into a mixed multichannel audio that is communicated to a remote computing device. The method transmits a sample minimum duration of audio data retrieved from all channels during a polling or call interval to provide low latency transmission of audio to remotely connected computing devices.

In accordance with aspects of the disclosure, there is provided a method of communicating mixed multichannel audio associated with a source to a remote client computing device as single channel audio using a remote access server. The method may include determining a source-depleted time for each channel of the multichannel audio;

determining if there is audio data present on all channels at the source; determining a sample minimum amount of audio that is present for all of the channels; mixing the sample minimum amount of audio for each of the channels of the multichannel audio into the single channel audio; and communicating the single channel audio to the remote client computing device.

In accordance with other aspects of the present disclosure, there is provided an apparatus for communicating mixed multichannel audio associated with a source to a remote client computing device as single channel audio. The apparatus may include a memory that stores computer-executable instructions, a processor that executes the computer-executable instructions to such that the apparatus performs determining a source-depleted time for each channel of the multichannel audio; determining if there is audio data present on all channels at the source; determining a sample minimum amount of audio that is present for all of the channels; mixing the sample minimum amount of audio for each of the channels of the multichannel audio into the single channel audio; and communicating the single channel audio to the remote client computing device.

In accordance with yet other aspects of the present disclosure, there is provided a tangible computer readable medium containing computer executable instructions that executed by a processor of a computing device causes the processor to execute a method of communicating mixed multichannel audio associated with a source to a remote client computing device as single channel audio from a remote access server. The executable instructions may case the computer to determine a source-depleted time for each channel of the multichannel audio; determine if there is audio data present on all channels at the source; determine a sample minimum amount of audio that is present for all of the channels; mix the sample minimum amount of audio for each of the channels of the multichannel audio into the single channel audio; and communicate the single channel audio to the remote client computing device.

These and other objects and advantages may be provided by the embodiments of the disclosure, including some implementations exemplified in the description and figures.

BRIEF DESCRIPTION OF THE DRAWINGS

The accompanying drawings, which are incorporated in and constitute a part of this disclosure, illustrate various implementations. Like reference numerals are used to reference like elements throughout. In the drawings.

DETAILED DESCRIPTION OF THE DISCLOSURE

Unless defined otherwise, all technical and scientific terms used herein have the same meaning as commonly understood by one of ordinary skill in the art. While implementations of the disclosure will be described for providing remote access to multi-channel audio produced by, e.g., an application program by mixing the multiple channels into a mixed multichannel audio (a single audio channel) that is communicated to a remote computing device.

Figure 1:
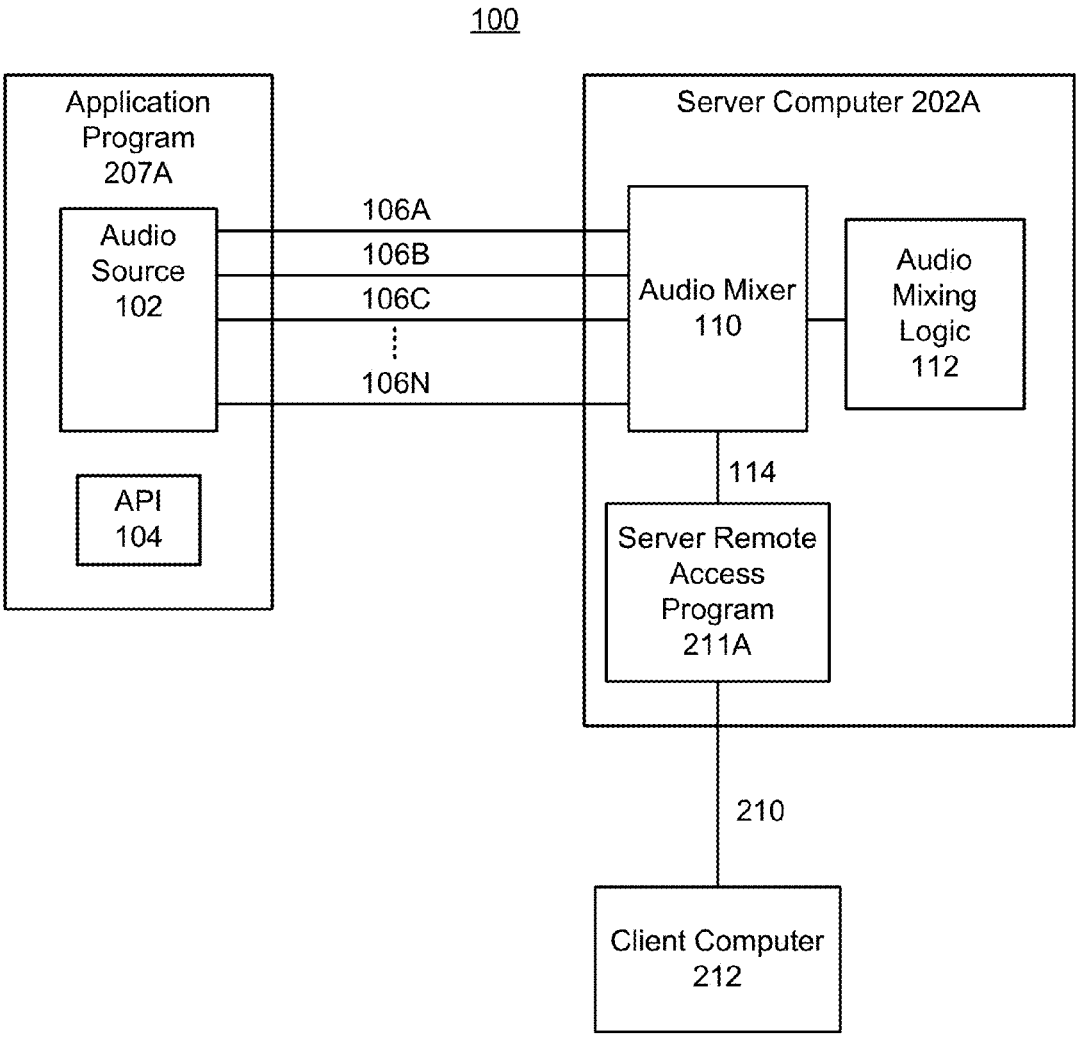
FIG. 1 illustrates simplified block diagram of an environment for providing multi-channel audio to a remote client computing device.

FIG. 1 illustrates simplified block diagram of an environment 100 for providing multi-channel audio to a remote client computing device. In the environment 100, an audio source 102 may output multiple channels of audio 106A, 106B, 106C . . . 106N for consumption by, e.g., a client computer 212. The audio source 102 may be provided by, e.g., an application program 207A such as a game, conferencing application, video application, etc. The multiple channels of audio 106A, 106B, 106C . . . 106N, maybe acquired by a server computer 202B using an application programming interface (API) 104 exposed by the application program 207A that may be called by a server remote access program 211A. In particular, the server remote access application 211A may periodically poll the API 104 using a polling method (called herein "GetNextChunk") to determine if audio data is ready to be sent on any of the multiple channels of audio 106A, 106B, 106C . . . 106N. The polling of the API 104 may be performed at regular intervals, e.g. 15 ms to pull audio data from the source (i.e., the application program 207A). The polling interval may be defined by a remote access infrastructure, such as that illustrated in FIG. 4. It is noted that other time intervals may be implemented in accordance with communication latencies associated with the environment 100.

When the API 104 is called, an audio chunk may be returned for each of the multiple channels of audio 106A, 106B, 106C . . . 106N producing audio. If a particular channel or channels have not produced audio, then no audio chunks are returned for those channels. An audio mixer 110 may receive audio from the multiple channels of audio 106A, 106B, 106C . . . 106N and mix the audio together in accordance with audio mixing logic 112 to create mixed multichannel audio 114. The audio mixer 110 may be implemented via hardware and/or software may include a plurality of channel inputs for receiving the multiple channels of audio 106A, 106B, 106C . . . 106N. Each channel may be manipulated to control one or more aspects of the received audio stream, such as tone, loudness, or dynamics, etc.

Figure 2:
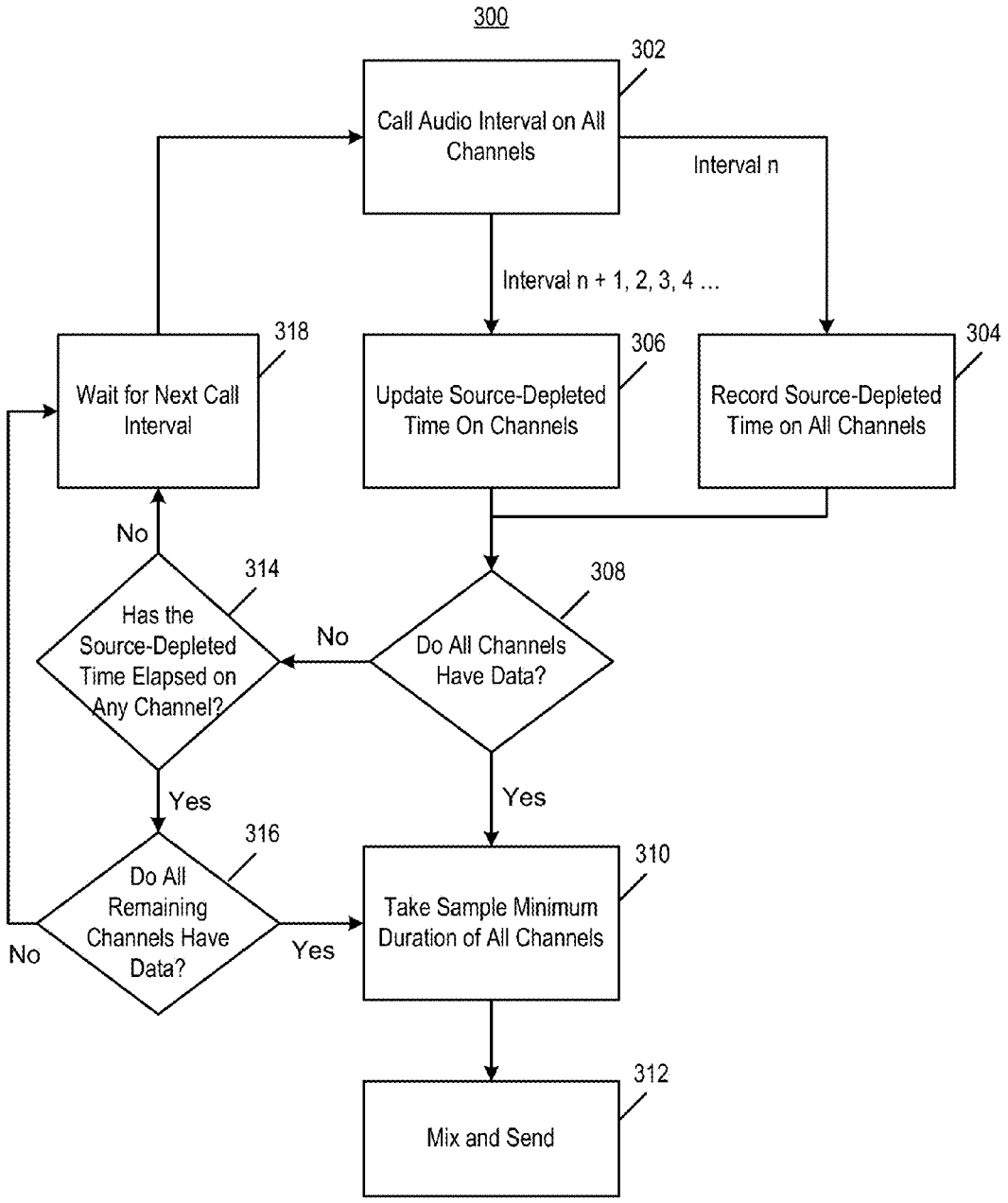
FIG. 2 illustrates an operational flow diagram of the processes that are performed in accordance with the present disclosure.
Figure 3:
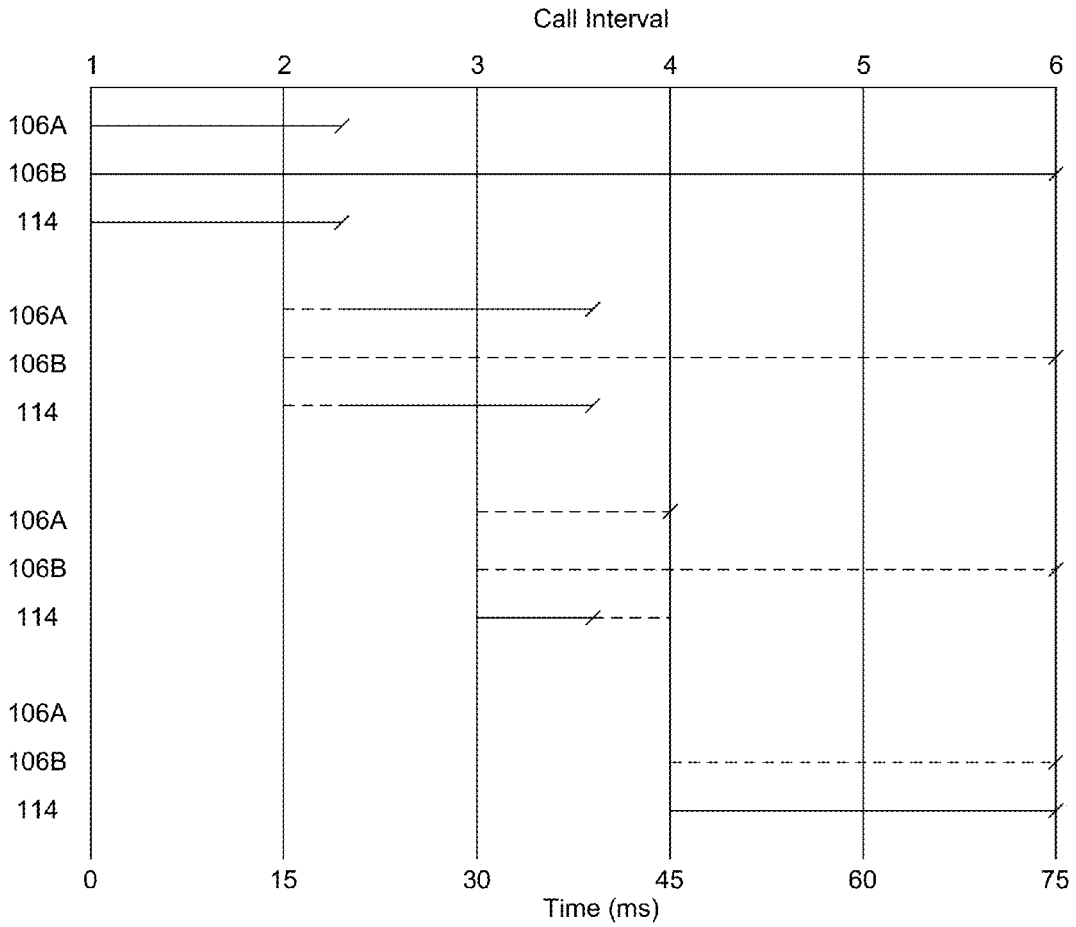
FIG. 3 illustrates a timing diagram illustrating the mixing of audio channels into a mixed multichannel audio.

The audio mixing logic 112 is described in further detail with regard to FIGS. 2-3 and may include both hardware and/or software for controlling the processing of audio received by the mixer 110. For example, the audio mixing logic 112 may instruct the mixing of the audio by the audio mixer 110 in accordance with certain requirements. The requirements may include, but are not limited to, sending audio to a remote client computing device 212 as quickly as it is received in order to achieve low latency, or sending as much audio that is available to achieve a minimum feasible transmission. The mixing logic 112 may be programmed with other information such as a number of channels (106A, 106B, 106C . . . 106N), a length of the mixer output sample, and a number output samples per second in order to instruct the processing of the incoming audio to the audio mixer 110.

The mixed multichannel audio 114 may be communicated by the server remote access program 211A to the remote client computing device 212 over a communication network 210. The communication network 210 may be any communication connection, as will be described with regard to FIG. 4. In addition, although FIG. 1 illustrates only one remote client computing device 212, there may be plural remote client computing devices that simultaneously and/or collaboratively are connected to the server remote access program 211A and receiving mixed multichannel audio 114. Further, as will be described, the client computer 212 may be any computing device such as a desktop computing device, a tablet computing device, a notebook computing device, a handheld wireless communication device, etc.

Audio Mixing Logic

FIG. 2 illustrates an operational flow diagram of the processes 300 performed to communicate mixed multichannel audio in accordance with the present disclosure. The processes 300 may be implemented, for example, to provide mixed multichannel audio as single channel audio to the client computer 212. Initially, before the execution of the processes 300, the application program 207A and server remote access program 211A are executed.

At 302, a call audio is performed on all channels at predetermined intervals of time. In accordance with aspects of the present disclosure, the API 104 may be called by a polling method called GetNextChunk, which is called at, e.g., regular intervals of 15 ms. The intervals may be determined in accordance with the latency of the network 210 or other factors to provide delivery of audio to the client computer at a predetermined level of quality. At 304, for a first interval n, a source-depleted time is recorded on all channels. The source-depleted time is the time at which there will be no more audio data on a particular channel. The time may be an elapsed running time or a clock time.

At 306, for intervals n+1, 2, 3, 4, etc., the source-depleted time is updated for all channels. Next, at 308, it is determined if all channels have audio data. For example, in response to the call made by GetNextChunk, an audio chunk may be returned for each source channel having produced audio data since a last call by GetNextChunk. If no audio data has been produced by a channel, an IsEmpty property of GetNextChunk is set to "true" for that channel.

At 310, if all channels have audio data, then a sample minimum duration of all channels is taken. For example, the minimum duration may be the least duration of audio data produced by one of the multiple channels. At 312, the audio data on all of the channels for the minimum duration amount of time is mixed and sent to the remote client computing device. For example, the audio mixer 110 may mix audio data from the multiple channels of audio 106A, 106B, 106C . . . 106N into the mixed multichannel audio 114, which is then communicated to the client computer 212 over the network 210.

If, however, at 308 all channels do not have data, then it is determined at 314 whether the source-depleted time has elapsed for any of the channels. If not, then at 318 the process waits for the next call interval and returns to 302 when the next call interval begins. If, however, at 314 the source-depleted time has elapsed on a channel, then it is determined if the remaining channels have data. If so, then the sample minimum duration of all channels having audio data is taken at 310, and the audio data is mixed and sent to the client computer at 312. Thus, even though all channels did not have data, there is still previously retrieved data on at least one of the channels to communicate to the client computer.

However, if it 316 the remaining channels do not have data, then the process flows to 318 where it waits for the next call interval at 302. In such a circumstance, there may be a "hiccup" in the audit transmission as there is no audio data to be transferred to the client computer in the current interval.

FIG. 3 illustrates a timing diagram illustrating of processes 300 of FIG. 2 with respect to two channels of audio data. It is noted that more than two channels of audio data may be mixed together to create the mixed multichannel audio 114. Beginning at time zero (call interval 1) a call (302) to GetNextChunk may retrieve 20 ms of audio data from channel 106A and 75 ms of audio data from channel 106B. Thus, the source-depleted time for channel 106A is 20 ms and the source-depleted time for channel 106B is 75 ms (304 and 306). The minimum duration of all channels (310) is 20 ms, therefore 20 ms of audio is mixed and sent to the client computer as mixed multichannel audio 114 (312).

At time 15 ms (call interval 2) a call to GetNextChunk (302) retrieves an additional 20 ms of audio data for channel 106A. Channel 106B provides no additional audio data at call interval 2, and IsEmpty is set to "true." As a result, the source-depleted time for channel 106A is updated to be 40 ms and the source-depleted time for channel 106B remains 75 ms (304 and 306). The minimum duration of all channels (310) is 20 ms, therefore an additional 20 ms of audio is mixed and sent to the client computer as mixed multichannel audio 114 (312).

At time 30 ms (call interval 3), a call to GetNextChunk (302) retrieves no audio data from both channels 106A and 106B. As such, the source-depleted time for channel 106A is 40 ms and the source-depleted time for channel 106B is 75 ms (304 and 306). At call interval 3, all channels do not have data (308), and the source-depleted time will not yet have elapsed for any of the channels 106A and 106B (314). This is because the source-depleted time for channel 106A does not elapse until 40 ms. As such, no audio data is mixed and sent to the client computer, rather processing waits for the call interval 4 (318). However, as shown in FIG. 3, there the mixed multichannel audio 114 only until time equal to 40 ms. As such, the mixed multichannel audio 114 runs out of data 5 ms before the onset of call interval 4. In this circumstance, a user at the client computer 212 will experience a short period of silence.

At time 45 ms (call interval 4), a call to GetNextChunk (302) again results in no audio data being returned on either of channels 106A and 106B. As such, the source-depleted time for channel 106A has elapsed (i.e., is −5 ms) and the source-depleted time for channel 106B is 35 ms (304 and 306). During call interval 4, all channels do not have data (308) and the source depleted time has elapsed for channels 106A (314). Channel 106B has remaining audio data (316), and the sample minimum duration of all channels (310) is 35 ms, which is the amount sent to the client computer as mixed multichannel audio 114 (312).

Thus, FIG. 3 illustrates the operations 300 for two channels of audio that are mixed as multichannel audio delivered to a remote client computing device connected to a remote access program over a network.

Additionally or alternatively to the operation described with regard to FIGS. 2 and 3, the GetNextChunk method may call an API unregister a particular channel with the mixer 110. For example, a channel may not produce data for some period of time; however, will produce data at a later period in time. For example, in a timing diagram of FIG. 3, the channel 106B did not return audio data at call intervals 2-4 and channel 106A did not return audio data at call intervals 304. It is possible that either or both may return audio data at a later call interval. However, if a particular channel will no longer produce audio data, it may be unregistered with the mixer 110, such that the mixture 110 no longer expends resources poling the channel.

Remote Access Environment

Figure 4:
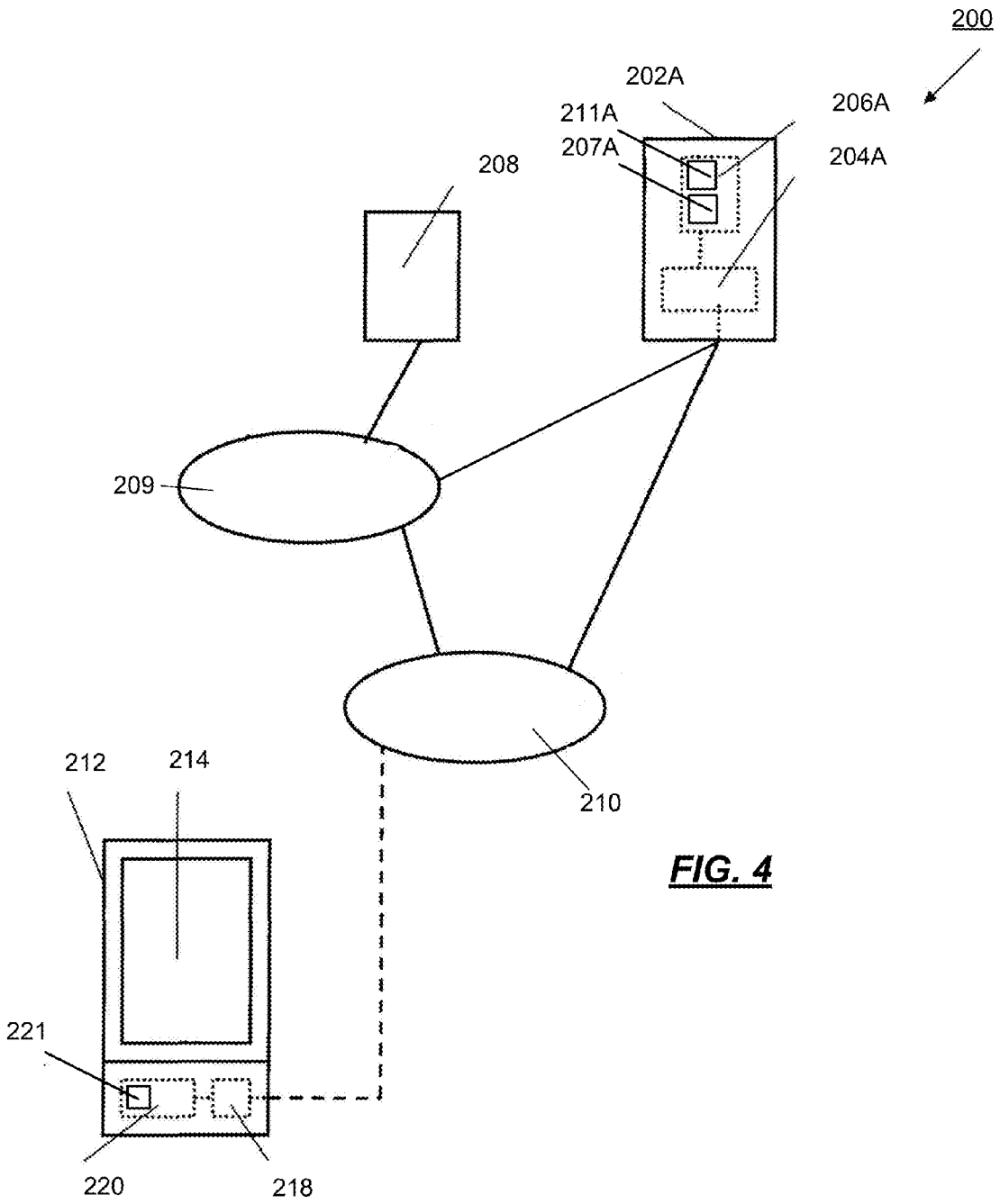
FIG. 4 is a simplified block diagram of a system for providing remote access to audio data on a mobile device via a computer network.

With reference to FIG. 4, there is illustrated an example non-limiting system 200 for providing mixed multichannel audio via a computer network according to the present disclosure. The system 200 comprises the client computer 212, which may be a wireless handheld device such as, for example, an IPHONE, an ANDROID device, a BLACKBERRY, (or other any other mobile device) connected via the communication network 210 such as, for example, the Internet, to the server computer 202A. Other client computers 212 may be connected to the communication network 210, such as desktop computers, laptop/notebook computers, thin client devices, tablet computers, virtual computers, etc., that are either wired or wirelessly connected to the communication network 210. It is noted that the connections to the communication network 210 may be any type of connection, for example, Wi-Fi (IEEE 802.11x), WiMax (IEEE 802.16), Ethernet, 3G, 4G, etc. The server computer 202A and the client computer 212 may be implemented using hardware such as that shown in the general purpose computing device of FIG. 8.

The server computer 202A may be connected to a Local Area Network (LAN) 209 or a second LAN (not shown). An optional database 208 may be connected to the LAN 209 such that it is accessible by the server computer 202A. The LANs may be omitted and the server computer 202A may be directly connected to the computer network 210 with the database being directly connected to the server computer 202A.

The application program 207A may execute on the server computer 202A. The application program 207A may be any application, and in accordance with aspects of the present disclosure, application provides multi-channel audio as part of its execution.

According to some implementations, remote access to the application program 207A may be enabled by, for example, executing a server remote access program 211A on the processor 204A of the server computer 202A, and a respective client remote access program 221 executed on a processor 218 of the client computer 212. The server remote access program 211A may be performed by executing executable commands stored in the memory 206A of the server computer 202A, while the client remote access program 221 is performed by executing executable commands stored in memory 220 of the client computer 212. The server remote access program 211A communicates with the application program 207A. An example of the server remote access program is PUREWEB, available from Calgary Scientific, Inc. of Calgary, Alberta, Canada.

The client remote access program 221 communicates with a user interaction program 250 (FIGS. 5A, 5B and 6) such as, for example, a web browser for displaying data such as, for example, audio data, image data, video data, etc. In accordance with aspects of the present disclosure, the client remote access application 121 may access the server remote access program 211A via a Uniform Resource Locator (URL). A user interface of the user interaction program 250 may be implemented using, for example, Hyper Text Markup Language HTML 5. User input data for interacting with the application program 207A may be receive using, for example, a graphical display with a touch-screen 214.

The server remote access program and the client remote access program may be implemented using standard programming languages and communication is enabled using standard communication technologies such as, for example, Hyper Text Transfer Protocol (HTTP), virtual private networks (VPN), and secure socket layers (SSL), which are well known to those skilled in the art. Provision of the server remote access program and the client remote access program enable implementations of aspects of the disclosure as a retrofit to existing technologies on the server side as well as on the client side.

Figure 5A:
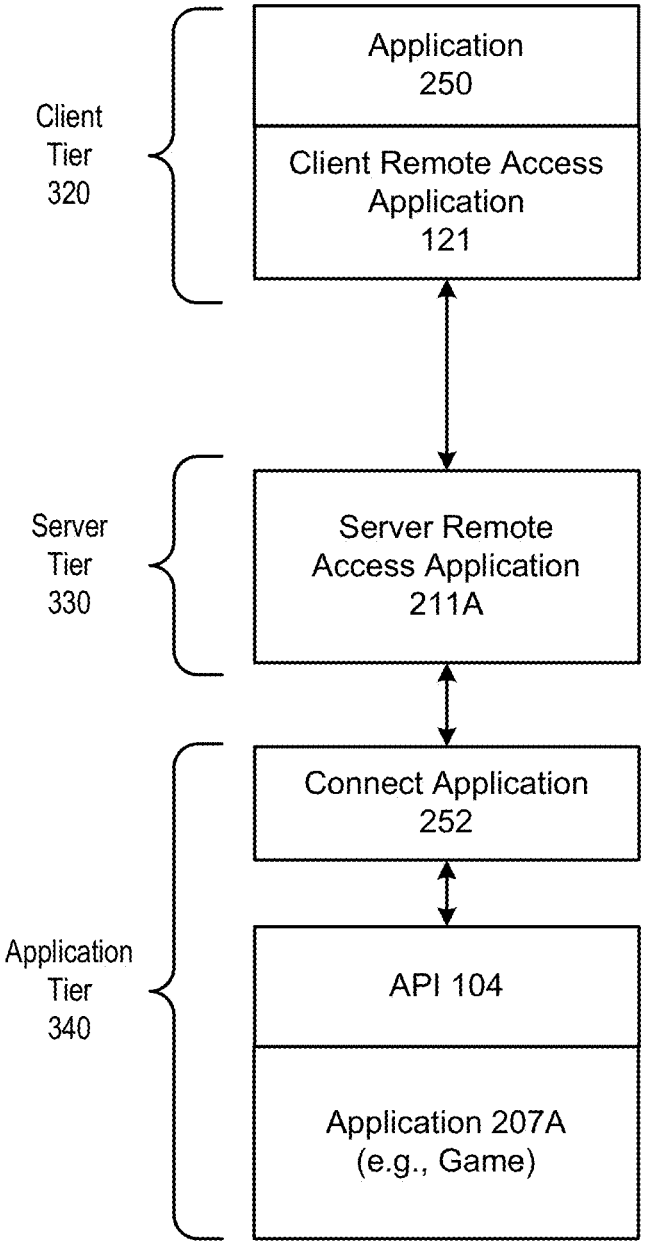
FIGS. 5A and 5B illustrate additional aspects of the system of FIG. 4.
Figure 5B:
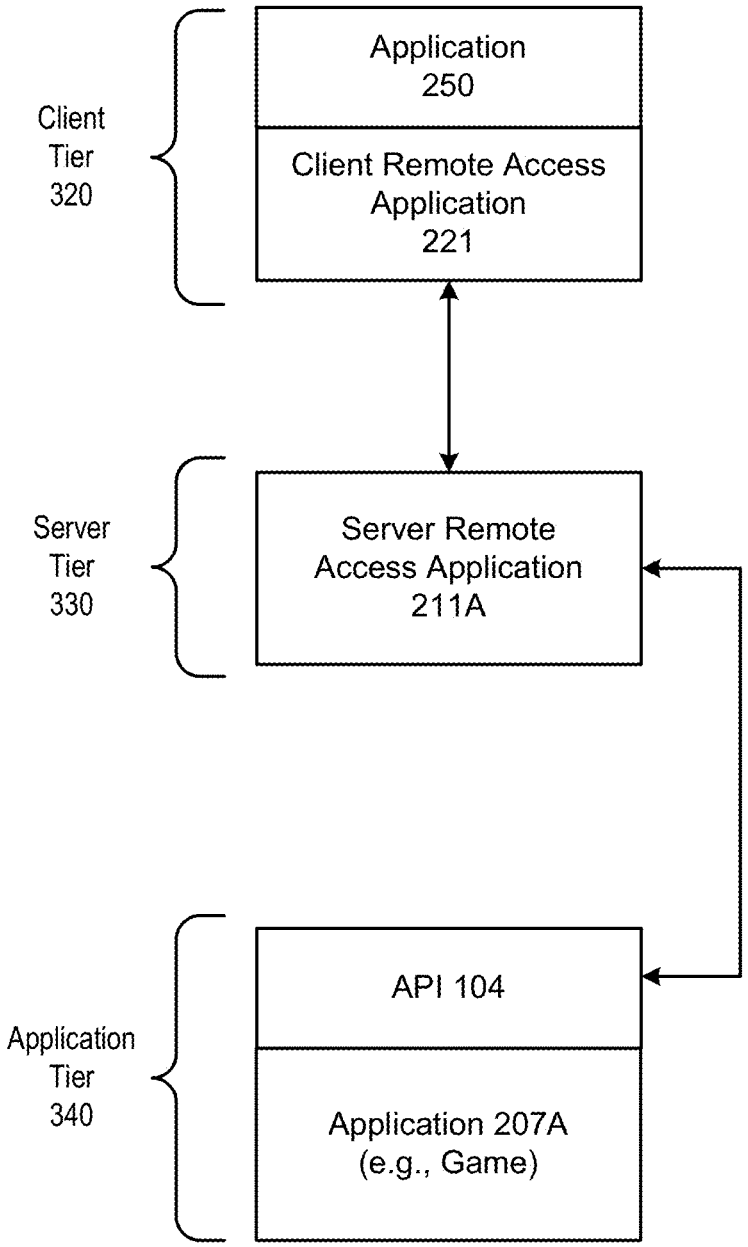

Turning now to FIGS. 5A and 5B there is illustrated additional details of the system 200. As shown, the system 200 may have a tiered infrastructure, where a client tier 320 and a server tier 330 communicate information, data, messages, etc., between each other. The server tier 330 may communicate information, data, messages, etc., with an application tier 340. As illustrated, the application program 207A may reside on different machine or may be accessible via a different network infrastructure than the server remote access application 211A. In FIGS. 5A and 5B, the client tier 320, the server tier 330 and the application tier 340 provide an infrastructure for communication during a session between a client (in the client tier 320) and an application program (e.g., 207A in the application tier 340).

In the client tier 320, the user interaction program 250 may be a web browser, a SILVERLIGHT application, a FLASH application, or a native application that interfaces with the client remote access application 221. The client remote access application 221 communicates with the server remote access application 211A in the server tier 330. Data, commands, and other information may be exchanged between the client remote access application and the server remote access application to enable the user interaction program 200 to interact with one or more of application programs 207A.

With reference to FIG. 5A, the server tier 330 includes the server remote access application 211A, which initially communicates with a "connect" application 252 in the application tier 340. The connect application 252 may take one or more arguments that includes an indication of an application (e.g. application program 207A) in order to begin the execution of the application program 207A on the server computing device. The connect application 252 may include two components, an API hooking library (not shown) and the API 104 (as a Remoting DLL). An example of the API hooking library is the Easy Hook library available at easyhook.codeplex.com/releases. The API hooking library operates to inject the API 104 into an address space of the application program 207A. After the DLL injection is complete, the connection between the application program 207A and the connect application 252 is closed.

Thereafter, as shown in FIG. 5B, the application program 207A is able to communicate with the server remote access application 211B via the API 104 and vice versa. Thus, the API 104, when injected into the application program 207A, provides a mechanism for server remote access program 211B to interact with the application program 207A to pull audio data with the without a need to change the source code of the application program 207A. As noted above, the API 104 will communicate sound to the server remote access application 211B, which is communicated to the connected client computing devices for output to the user.

Figure 6:
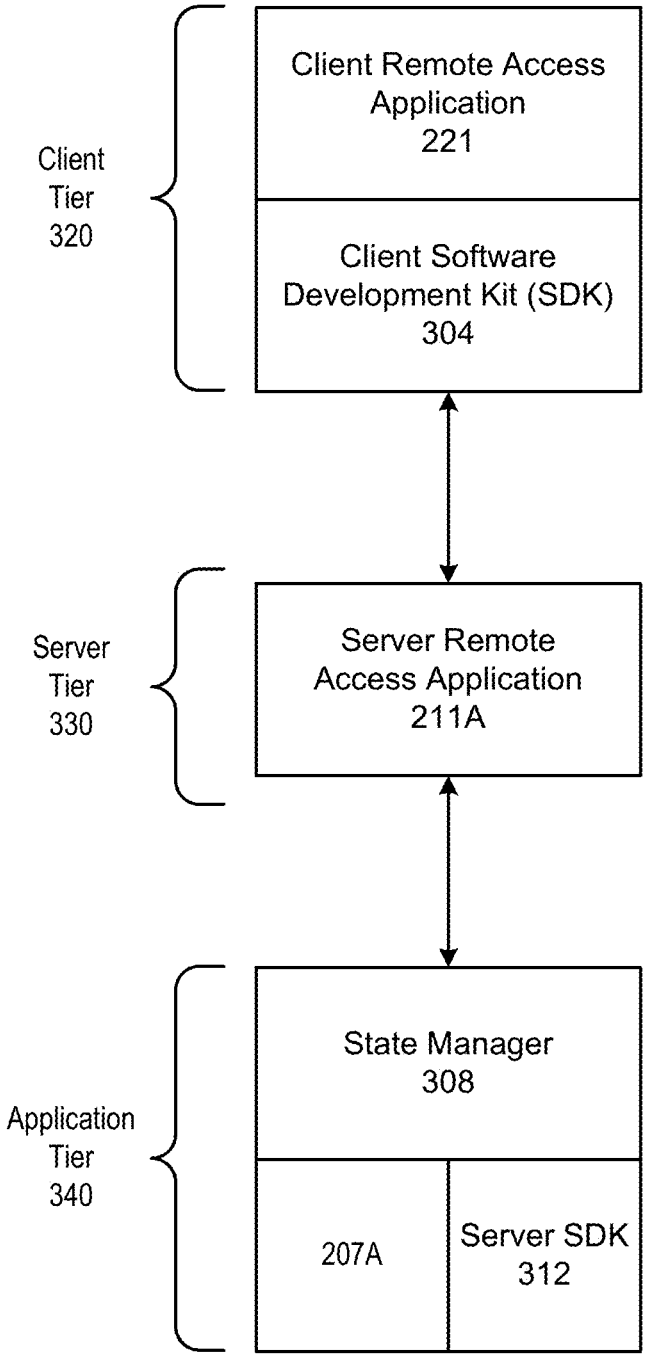
FIG. 6 illustrates additional aspects of the system of FIG. 4.

FIG. 6 illustrates additional aspects of the system 200 of FIG. 4. As illustrated, system 200 may be provided as having a tiered software stack and may utilize software development kits rather than DLL injection to enable the server remote access program to retrieve audio data from application 207A. As illustrated, the client remote application 221 may sit on top of a client software development kit (SDK) 304 in a client tier 320. The client tier 320 communicates to the server remote access application 211A in a server tier 330. The server tier 330 communicates to a state manager 308 sitting on top of the application 207A and a server SDK 312 in an application tier 340. The server remote access application 211A may poll the SDK 312 to retrieve audio data from multiple audio channels associate with the application 207A. Upon receipt of audio data from an application program 207A, the server remote access application 211A mixes and provides the same to the client remote access application 221 on the client computing device 212.

In some implementations, the application tier 340 and server tier 330 of FIGS. 5A, 5B and 6 may be implemented within a cloud computing environment to provide remote access to the application programs 207A. As described above, cloud computing is a model for enabling network access to a shared pool of configurable computing resources (e.g., networks, servers, storage, applications, and services) that can be provisioned and released with minimal interaction. The cloud computing model promotes high availability, on-demand self-services, broad network access, resource pooling and rapid elasticity. In such an environment, the application programs 207A may be accessed by the client computing devices 212 through a client interface, such as a client remote access application 221. As in the above, the application programs 207A may be put in the cloud without a need to change the source code.

Multi-Server Remote Access Environment

Figure 7:
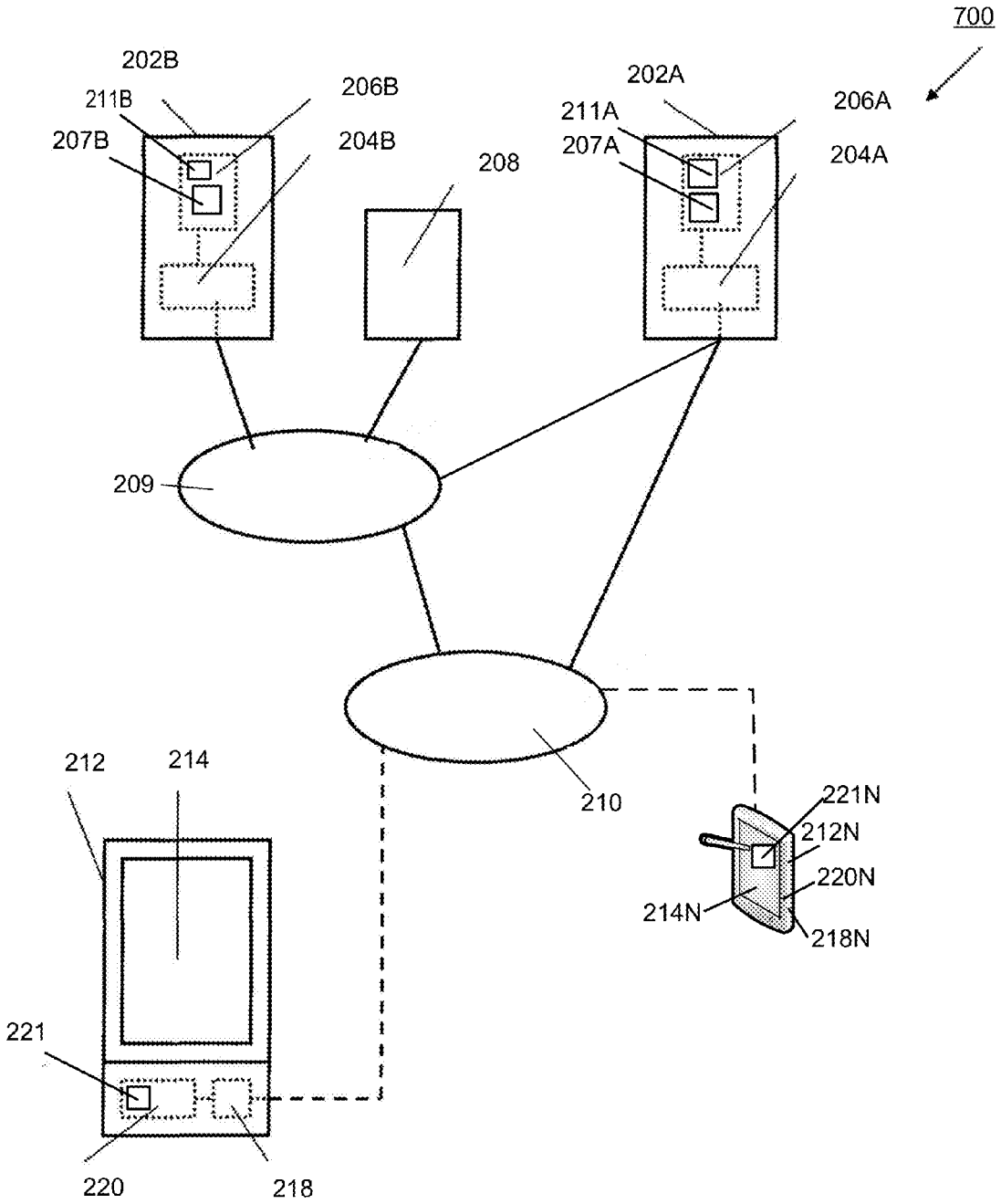
FIG. 7 is another simplified block diagram of a system for providing remote access to audio data on a mobile device via a computer network.

With reference to FIG. 7, there is illustrated an example non-limiting system 700 for providing mixed multichannel audio via a computer network according to the present disclosure. The system 700 includes a second server computer 202B in addition to the server computer 202A. With regard to the system 700, like numerals denote like elements shown in FIGS. 4, 5A, 5B and 6, as such they will not be discussed again below.

The second application program 207B may execute on the second server computer 202, and may be any application, and in accordance with aspects of the present disclosure, applications that provide multi-channel audio as part of it execution. Remote access to the second application program 207B may be enabled, for example, by executing the second server remote access program 211B on the processor 204B of the second server computer 202B, and a respective client remote access program 221 executed on a processor 218 of the client computer 212. The second server remote access program 211B may be performed by executing executable commands stored in the memory 206B of the second server computer 202B. The second server remote access program 211B communicates with the second application program 207B. Alternatively, one of the first and the second server remote access programs 211A and 211B may be omitted and the other may communicate with one or both of the first and second application programs 207A and 207B. The client remote access application 121 may access the server remote access program 211B via a Uniform Resource Locator (URL).

Collaborative Remote Access Environment

FIG. 7 also shows a second client computer 212N that may be connected to the communication network 210. For example, the second client computer 212N may be a touch-enable device that may be wirelessly connected to the communication network 210. The client computer 212N may be implemented using hardware such as that shown in the general purpose computing device of FIG. 8.

According to some implementations, remote access to the application program 207A may be enabled by the server remote access program 211A, and a respective client remote access program 221N executed on a processor 218N of the client computer 212N. The client remote access program 221N is performed by executing executable commands stored in memory 220N of the client computer 212N. The client remote access application 121N may access the server remote access program 211A via a Uniform Resource Locator (URL).

In some implementations, the client computing devices 212, 212N may participate in a collaborative session. For example, one of the application program 207A or the second application program 207B may enable the server 202A or the second server 202B to collaboratively interact with the client remote access applications 221, 221N. As such, each of the participating client computing devices 212, 212N may present a synchronized view of the display of the application program 207A or the second application program 207B. This enables each of the participants in the collaborative session (utilizing the client computing devices 212, 212N) to interact with, and control, the application program 207A or the second application program 207B. Mixed multichannel audio associated the application program 207A or the second application program 207B is also synchronized and provided to each of the participating client computing devices 212, 212N.

Figure 8:
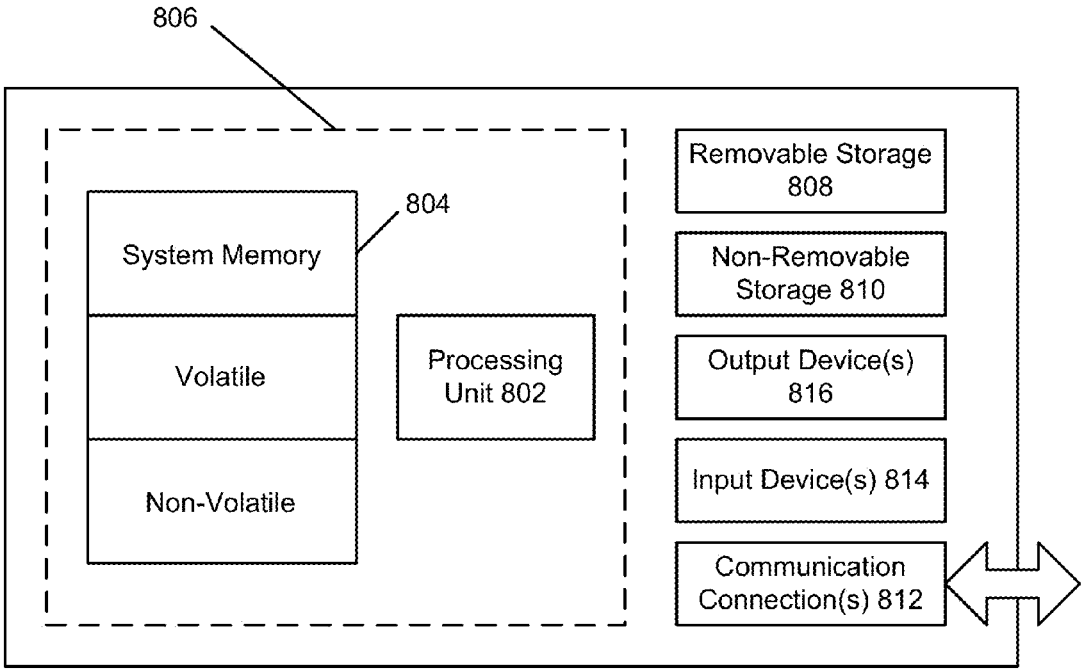
FIG. 8 shows an exemplary computing environment in which example aspects of the present disclosure may be implemented.

FIG. 8 shows an exemplary computing environment in which example aspects of the present disclosure may be implemented. The computing system environment is only one example of a suitable computing environment and is not intended to suggest any limitation as to the scope of use or functionality.

Numerous other general purpose or special purpose computing system environments or configurations may be used. Examples of well known computing systems, environments, and/or configurations that may be suitable for use include, but are not limited to, personal computers, server computers, handheld or laptop devices, multiprocessor systems, microprocessor-based systems, network personal computers (PCs), minicomputers, mainframe computers, embedded systems, distributed computing environments that include any of the above systems or devices, and the like.

Computer-executable instructions, such as program modules, being executed by a computer may be used. Generally, program modules include routines, programs, objects, components, data structures, etc. that perform particular tasks or implement particular abstract data types. Distributed computing environments may be used where tasks are performed by remote processing devices that are linked through a communications network or other data transmission medium. In a distributed computing environment, program modules and other data may be located in both local and remote computer storage media including memory storage devices.

With reference to FIG. 8, an exemplary system for implementing aspects described herein includes a computing device, such as computing device 800. In its most basic configuration, computing device 800 typically includes at least one processing unit 802 and memory 804. Depending on the exact configuration and type of computing device, memory 804 may be volatile (such as random access memory (RAM)), non-volatile (such as read-only memory (ROM), flash memory, etc.), or some combination of the two. This most basic configuration is illustrated in FIG. 8 by dashed line 806.

Computing device 800 may have additional features/functionality. For example, computing device 800 may include additional storage (removable and/or non-removable) including, but not limited to, magnetic or optical disks or tape. Such additional storage is illustrated in FIG. 8 by removable storage 808 and non-removable storage 810.

Computing device 800 typically includes a variety of computer readable media. Computer readable media can be any available media that can be accessed by device 800 and includes both volatile and non-volatile media, removable and non-removable media.

Computer storage media include volatile and non-volatile, and removable and non-removable media implemented in any method or technology for storage of information such as computer readable instructions, data structures, program modules or other data. Memory 804, removable storage 808, and non-removable storage 810 are all examples of computer storage media. Computer storage media include, but are not limited to, RAM, ROM, electrically erasable program read-only memory (EEPROM), flash memory or other memory technology, CD-ROM, digital versatile disks (DVD) or other optical storage, magnetic cassettes, magnetic tape, magnetic disk storage or other magnetic storage devices, or any other medium which can be used to store the desired information and which can be accessed by computing device 800. Any such computer storage media may be part of computing device 800.

Computing device 800 may contain communications connection(s) 812 that allow the device to communicate with other devices. Computing device 800 may also have input device(s) 814 such as a keyboard, mouse, pen, voice input device, touch input device, etc. Output device(s) 816 such as a display, speakers, printer, etc. may also be included. All these devices are well known in the art and need not be discussed at length here.

It should be understood that the various techniques described herein may be implemented in connection with hardware or software or, where appropriate, with a combination of both. Thus, the methods and apparatus of the presently disclosed subject matter, or certain aspects or portions thereof, may take the form of program code (i.e., instructions) embodied in tangible media, such as floppy diskettes, CD-ROMs, hard drives, or any other machine-readable storage medium wherein, when the program code is loaded into and executed by a machine, such as a computer, the machine becomes an apparatus for practicing the presently disclosed subject matter. In the case of program code execution on programmable computers, the computing device generally includes a processor, a storage medium readable by the processor (including volatile and non-volatile memory and/or storage elements), at least one input device, and at least one output device. One or more programs may implement or utilize the processes described in connection with the presently disclosed subject matter, e.g., through the use of an application programming interface (API), reusable controls, or the like. Such programs may be implemented in a high level procedural or object-oriented programming language to communicate with a computer system. However, the program(s) can be implemented in assembly or machine language, if desired. In any case, the language may be a compiled or interpreted language and it may be combined with hardware implementations.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A method of communicating mixed multichannel audio associated with a source to a remote client computing device as single channel audio using a remote access server, comprising:

determining a source-depleted time at which there will be no more audio data for each channel of the multichannel audio;

determining if there is audio data present on all channels at the source;

determining if the source-depleted time for any channel of the multichannel audio has elapsed to determine a sample minimum amount of audio that is present for all of the channels;

mixing the sample minimum amount of audio for each of the channels of the multichannel audio into the single channel audio; and communicating the single channel audio to the remote client computing device.

2. The method of claim 1, wherein the determining if there is audio data present at the source is performed at a predetermined interval.

3. The method of claim 2, wherein the predetermined interval is 15 ms.

4. The method of claim 2, further comprising updating the source-depleted time for each channel at each predetermined interval.

5. The method of claim 1, wherein if all channels do not have data, the method further comprising waiting for a next call interval.

6. The method of claim 5, wherein if the source-depleted time has elapsed on a channel, then:

determining if the remaining channels have remaining audio data; and mixing the sample minimum duration of all channels having remaining audio data.

7. The method of claim 6, wherein if the remaining channels do not have remaining audio data, then waiting for the next call interval.

8. The method of claim 1, further comprising:

providing an application programming interface (API) associated with the audio source; and calling the API to determine if there is audio data present on all channels at the source.

9. The method of claim 8, wherein the calling to the API is made by the remote access server, and wherein source is associated with an application.

10. The method of claim 9, wherein the API is provided to the application by a software development kit.

11. The method of claim 9, wherein the API is injected into a running process associated with the application.

12. The method of claim 1, wherein the mixing is performed by the remote access server.

13. The method of claim 1, wherein the communicating of the single channel audio to the remote client computing device is performed over a standard communication channel to the remote client computing device.

14. The method of claim 13, wherein the standard communication channel comprises one of a hypertext transfer protocol connection, a virtual private network connection and a secure socket layer connection.

15. An apparatus for communicating mixed multichannel audio associated with a source to a remote client computing device as single channel audio, comprising:

a memory that stores computer-executable instructions;

a processor that executes the computer-executable instructions to such that the apparatus performs:

determining a source-depleted time at which there will be no more audio data for each channel of the multichannel audio;

determining if there is audio data present on all channels at the source;

determining if the source-depleted time for any channel of the multichannel audio has elapsed to determine a sample minimum amount of audio that is present for all of the channels;

mixing the sample minimum amount of audio for each of the channels of the multichannel audio into the single channel audio; and communicating the single channel audio to the remote client computing device.

16. The apparatus of claim 15, further comprising an application programming interface (API) that is associated with the audio source, wherein the processor executes instructions to call the API to determine if there is audio data present on all channels at the source.

17. The apparatus of claim 16, wherein the API is injected into a running process associated with an application that is associated with the source.

18. A non-transitory computer readable medium containing computer executable instructions that executed by a processor of a computing device causes the processor to execute a method of communicating mixed multichannel audio associated with a source to a remote client computing device as single channel audio from a remote access server, comprising:

determining a source-depleted time at which there will be no more audio data for each channel of the multichannel audio;

determining if there is audio data present on all channels at the source;

determining if the source-depleted time for any channel of the multichannel audio has elapsed to determine a sample minimum amount of audio that is present for all of the channels;

mixing the sample minimum amount of audio for each of the channels of the multichannel audio into the single channel audio; and communicating the single channel audio to the remote client computing device.

19. The tangible non-transitory computer readable medium of claim 18, further comprising instructions for:

determining if there is audio data present at the source is performed at a predetermined interval; and updating the source-depleted time for each channel at each predetermined interval.

20. The non-transitory computer readable medium of claim 18, wherein if the source-depleted time has elapsed on a channel, then further comprising instructions for:

determining if the remaining channels have remaining audio data; and mixing the sample minimum duration of all channels having remaining audio data.

* * * * *